US007679483B2

(12) United States Patent
Yuasa et al.

(10) Patent No.: US 7,679,483 B2
(45) Date of Patent: Mar. 16, 2010

(54) CORE FOR REACTOR

(75) Inventors: Hiroaki Yuasa, Toyota (JP); Shuichi Hirata, Nishikamo-gun (JP)

(73) Assignee: Toyota Jidosha Kabushiki Kaisha, Toyota-Shi (JP)

( * ) Notice: Subject to any disclaimer, the term of this patent is extended or adjusted under 35 U.S.C. 154(b) by 0 days.

(21) Appl. No.: 12/372,939

(22) Filed: Feb. 18, 2009

(65) Prior Publication Data

US 2009/0206971 A1 Aug. 20, 2009

(30) Foreign Application Priority Data

Feb. 18, 2008 (JP) ..... 2008-036132

(51) Int. Cl.
*H01F 27/24* (2006.01)

(52) U.S. Cl. ..... 336/219; 336/212; 336/196; 336/217

(58) Field of Classification Search ..... None
See application file for complete search history.

(56) References Cited

U.S. PATENT DOCUMENTS 6,232,864 B1 * 5/2001 Hosozawa et al. ..... 336/178
6,737,951 B1 * 5/2004 Decristofaro et al. ..... 336/234

FOREIGN PATENT DOCUMENTS

| | | |
|---|---|---|
| JP | 03092016 | 9/1991 |
| JP | 07272945 A | 10/1995 |
| JP | 09074021 A | 3/1997 |
| JP | 2006135018 | 5/2006 |
| JP | 2007173628 | 7/2007 |
| JP | 2007220916 A | 8/2007 |
| JP | 2008117978 | 5/2008 |

* cited by examiner

*Primary Examiner*—Anh T Mai
(74) *Attorney, Agent, or Firm*—Gifford, Krass, Sprinkle, Anderson & Citkowski, P.C.

(57) ABSTRACT

A core for a reactor includes: a plurality of core members, each of which has a convexly curved side face that serves as a bonding face; and a gap plate that is interposed between the curved side faces of the core members and that is bonded to the curved side faces. The gap plate includes a flat plate and a plurality of projections which project from each face of the plate and each of which has a tip end that contacts the curved side face. The projections are formed at positions near the outer edges of the plate, which are distant from the center of the plate at which no projection is formed, and which are at equal distances from the center of the plate.

4 Claims, 4 Drawing Sheets

CORE FOR REACTOR

INCORPORATION BY REFERENCE

The disclosure of Japanese Patent Application No. 2008-036132 filed on Feb. 18, 2008 including the specification, drawings and abstract is incorporated herein by reference in its entirety.

BACKGROUND OF THE INVENTION

1. Field of the Invention

The invention relates to a core that constitutes a reactor mounted on a hybrid vehicle or a fuel cell vehicle.

2. Description of the Related Art

Vehicles in which a driving force is produced by a motor, such as hybrid vehicles, electric vehicles, and fuel cell vehicles, have been drawing much attention as environmentally friendly vehicles. Generally, in such vehicles, direct-current voltage supplied from a secondary battery is converted into alternating-current voltage using an inverter and the alternating-current voltage is applied to a three-phase alternating current motor. In this process, a boost converter is used to boost the direct-current voltage supplied from the secondary battery before supplying this direct-current voltage to the inverter.

The boost converter may include a reactor having a core and a switching element. A core 10 in FIG. 3 is an example of existing cores. The core 10 includes two end core members 12, each of which is substantially U-shaped, and a plurality of substantially quadrangular prism-shaped intermediate core members 14. The intermediate core members 14 are adhesively-fixed to each other and linearly aligned between the ends of one of the end core members 12 and the ends of the other core members 12. In the core formed of the end core members 12 and the intermediate core members 14, gap plates 16 made of, for example, ceramic, are interposed between bonding faces of the core members in order to produce magnetic gap to avoid degradation of inductance.

As the core members 12 and 14 of the reactor, compressed powder magnetic cores that are produced as follows may be used. Soft magnetic powder of which the face is insulation-treated is mixed with a binder when necessary, and then the mixture is press-molded under a predetermined high pressure. Then, the press-molded mixture is sintered or thermally treated when necessary. Each core member has bonding faces to which adjacent core members are bonded when the core 10 is assembled. The bonding faces of the core member formed of the thus produced compressed powder magnetic core may be formed not into flat faces but into convexly curved side faces that convexly bulge outward slightly, due to, for example, residual inner stress caused during the press-molding process or thermal expansion caused during the sintering process.

Japanese Patent Application Publication No. 2006-135018 (JP-A-2006-135018) describes a technology for improving bond performance to avoid bond separation between a core member and a spacer 40. According to JP-A-2006-135018, as shown in FIG. 4, projections 44*a* and 44*b* that contact the core member are formed on a bonding face 42 of the spacer 40 to which the core member is bonded, whereby the amount of adhesive applied between the spacer 40 and the core member is increased. In this way, separation between the core member and the spacer is less likely to occur.

However, as shown in FIG. 5, if the spacer 40 described in JP-A-2006-135018 is provided between the core members 14 that have curved bonding faces 15, the projections 44*b* formed near the outer edges of the spacer 40 do not contact the core member 14, and only the projection 44*a* formed at the center of the spacer 40 contacts the curved bonding face 15. In this state, the core members 14 are adhesively-fixed to each other with an adhesive 24. In this case, linear alignment and configuration of the core members 14 along a direction X (shown in FIG. 3) between the end core members 12 is not ensured, and inclination or misalignment of the core members 14 in a direction Y and/or a direction Z tends to occur.

If the core 10 with the inclined core members 14 is fixed in a reactor case via brackets that support the end core members 12, stress concentration occurs in the adhesive 24 present between the core members 14 that are adhesively-fixed to each other and that are inclined, and bond separation is likely to occur at a portion in which the stress concentration occurs due to vibration or a temperature change during the operation of the reactor. This bond separation between the core members 14 may cause degradation of noise-vibration performance of the reactor.

SUMMARY OF THE INVENTION

The invention provides a core for a reactor, which is formed of a plurality of core members and gap plates interposed between the core members, and in which the core members are adhesively-fixed to each other in proper alignment without inclination.

An aspect of the invention relates to a core for a reactor, which includes: a plurality of core members, each of which has a convexly curved side face that serves as a bonding face; and a gap plate that is interposed between the curved side faces of the core members and that is bonded to the curved side faces. The gap plate includes a flat plate and a plurality of projections which project from each face of the plate and each of which has a tip end that contacts the curved side face. The projections are formed at positions near the outer edges of the plate, which are distant from the center of the plate at which projection is formed, and which are at equal distances from the center of the plate.

In the core according to the aforementioned aspect of the invention, the tip ends of the projections contact the convexly curved side face of each of the core members in a uniform manner. This makes it possible to adhesively-fix the core members to each other in the state where these core members are in proper alignment without inclination. Therefore, it is possible to suppress stress concentration in an adhesive portion between the core members, which is likely to occur when the core formed by adhesively-fixing the core members to each other is fixed in a reactor case. As a result, it is possible to maintain the strength of bond between the core members and suppress bond separation between the core members. This makes it possible to avoid degradation of noise-vibration performance of the reactor and to reduce variation in the noise-vibration performance among the reactors that have the same configuration.

BRIEF DESCRIPTION OF THE DRAWINGS

The features, advantages, and technical and industrial significance of this invention will be described in the following detailed description of example embodiments of the invention with reference to the accompanying drawings, in which like numerals denote like elements, and wherein.

DETAILED DESCRIPTION OF EMBODIMENT

An embodiment of the invention will be hereinafter described in detail with reference to the attached drawings. Specific configurations, materials, numbers, directions, etc., in the description below are just examples used to facilitate the understanding of the invention, and may be changed on an as-required basis in accordance with intended application, object, specification, etc.

Figure 3:
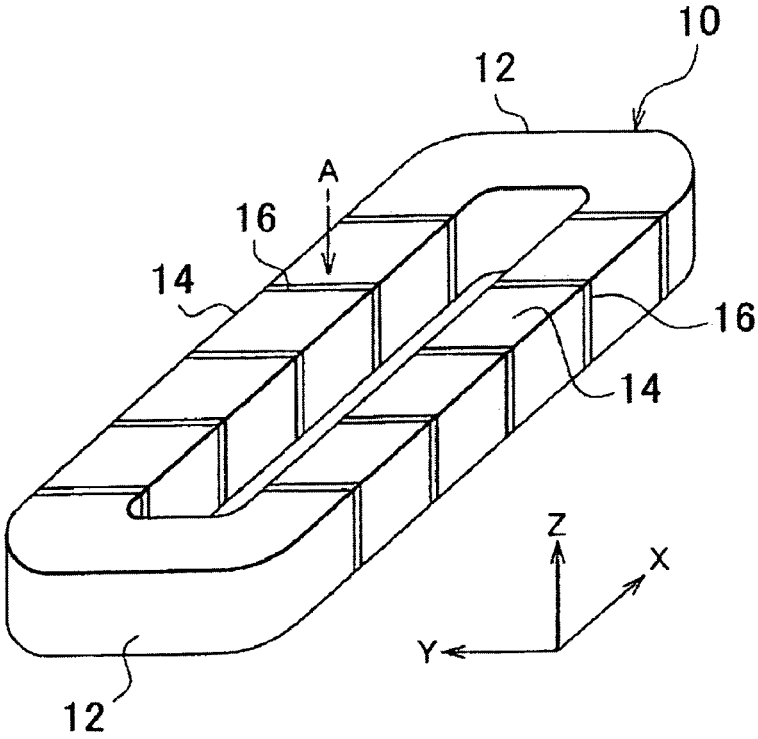
FIG. 3 is a perspective view showing the entirety of a core.
Figure 4:
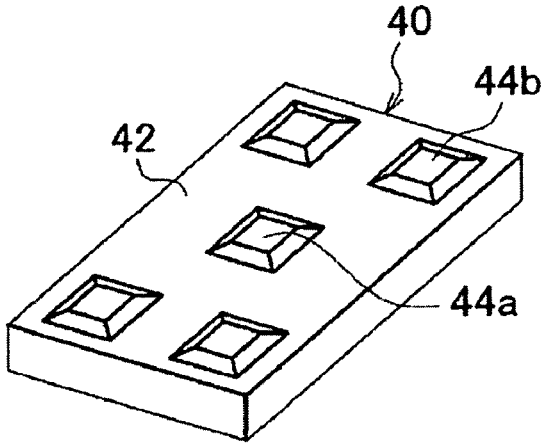
FIG. 4 is a perspective view of a spacer of the related art on which a projection is formed at the center of a plate that constitutes the spacer.
Figure 5:
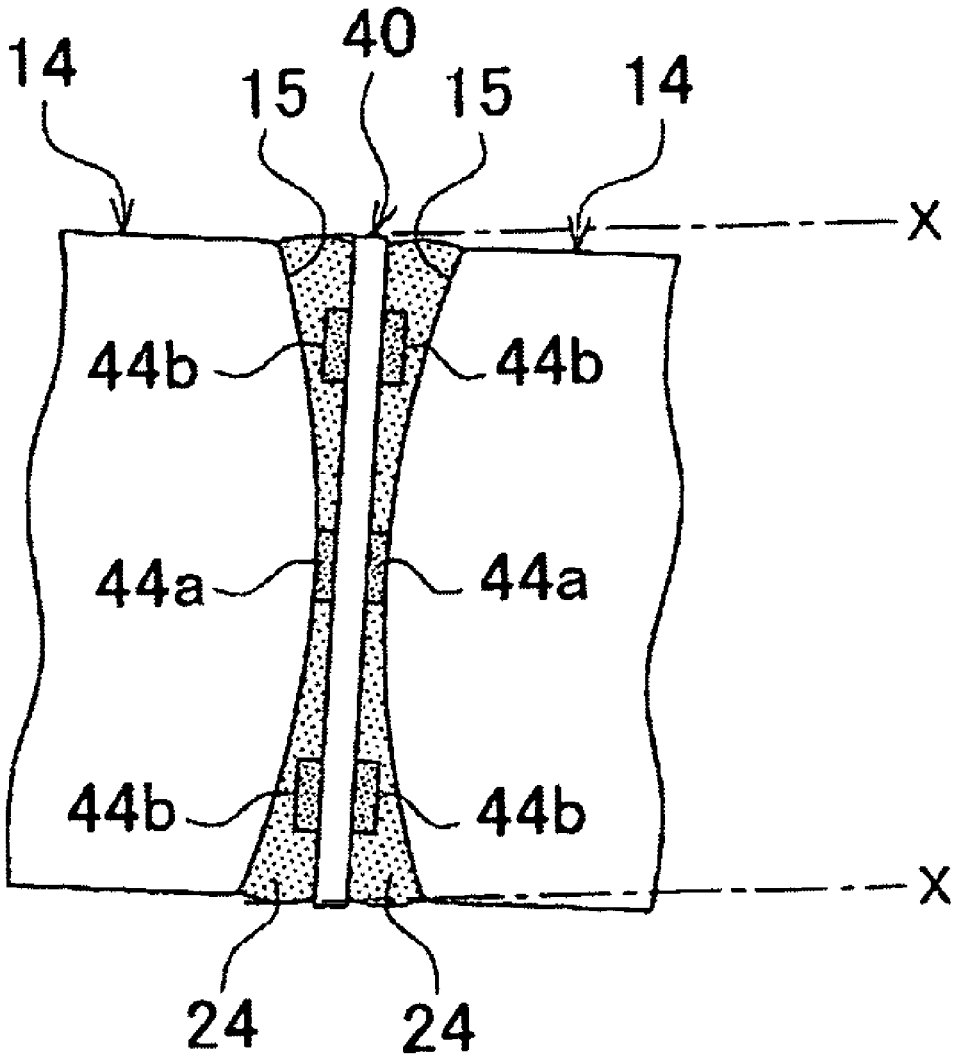
FIG. 5 is a partial plan view showing the manner in which the core member is inclined when the core members are adhesively-fixed to each other with the spacer shown in FIG. 4 interposed therebetween.

The outer configuration of a core 10 for a reactor according to the embodiment of the invention is the same as or similar to that shown in FIG. 3. In other words, the core 10 is formed of two end core members 12, each of which is substantially U-shaped, and a plurality of substantially quadrangular prism-shaped intermediate core members 14. The intermediate core members 14 are adhesively-fixed to each other and linearly aligned between the ends of one of the end core members 12 and the ends of the other core members 12. Each core member has bonding faces to which adjacent core members are bonded when the core 10 is assembled. Gap plates 16 are interposed between bonding faces of the end core members 12 and the intermediate core members 14 to produce magnetic gap in order to avoid degradation of inductance. The gap plates 16 are made of non-magnetic and insulative material such as ceramic or glass.

Figure 1A:
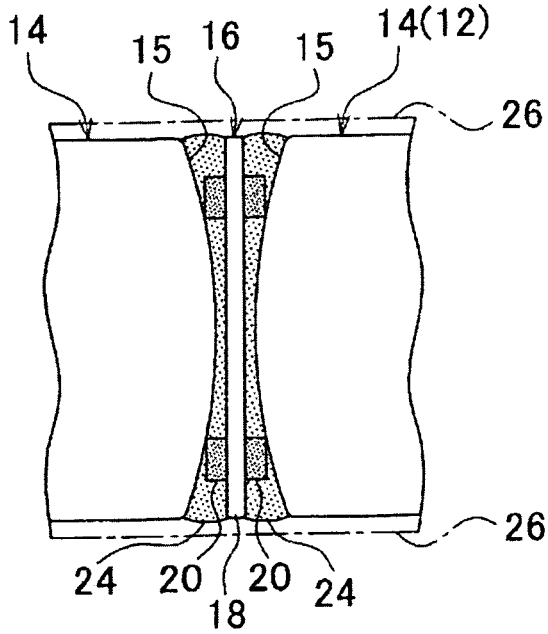
FIG. 1A is a partial plan view of a bonding portion that is present between intermediate core members and that includes a gap plate according to an embodiment of the invention.
Figure 2:
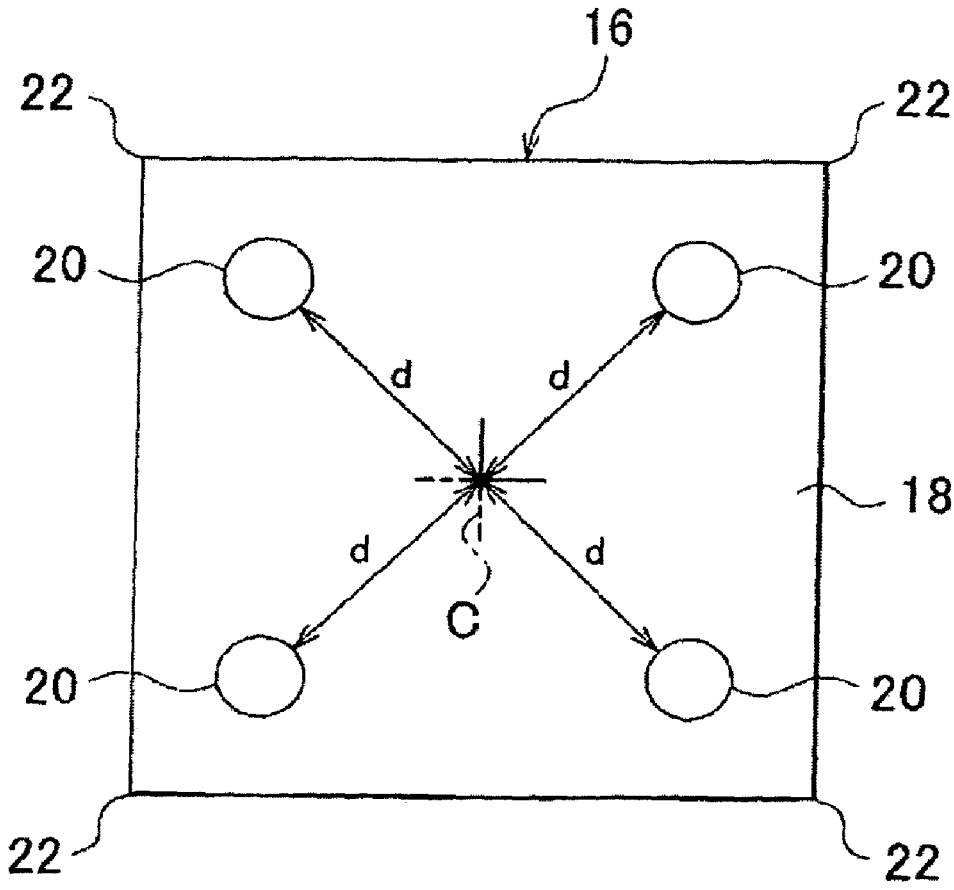
FIG. 2 is a plan view of the gap plate shown in FIG. 1A or FIG. 1B.

FIG. 1A is a partial plan view showing a bonding portion between the intermediate core members 14, when seen in the direction indicated by the arrow A in FIG. 3 or seen from above. FIG. 2 is a plan view of the gap plate 16. As the core members 12 and 14 of the reactor, compressed powder magnetic cores that arc produced as follows may be used. Soft magnetic powder of which the face is insulation-treated is mixed with a binder when necessary, and then the mixture is press-molded under a predetermined high pressure. Then, the press-molded mixture is sintered or thermally treated when necessary. The bonding faces of the core member formed of the thus produced compressed powder magnetic core may be formed not into flat faces hut into convexly curved side faces 15 that convexly bulge outward slightly, due to, for example, residual inner stress caused during the press-molding process or thermal expansion caused during the sintering process.

The gap plate 16 includes a plate 18 having a predetermined thickness and a plurality of projections 20 that are formed so as to project from each of the both faces of the plate 18. The plate 18 is formed in a rectangular shape that matches a contour of the curved side face 15 of the intermediate core member 14, which serves as the bonding face. Corners 22 of the plate 18 may be chamfered or rounded off, when necessary, for example, when the contour of the plate 18 needs to match the contour of the bonding face of the intermediate core member 14.

The projections 20 are formed at positions near the outer edges of the plate 18, which are distant from a plate center C at which no projection is formed. In addition, the projections 20 are at equal distances d from the plate center C. Further, the projections 20 are formed near the four corners 22 of the rectangular plate 18. In the embodiment of the invention, the number of the projections 20 formed on each of the faces of the gap plate 16 is four.

Figure 1B:
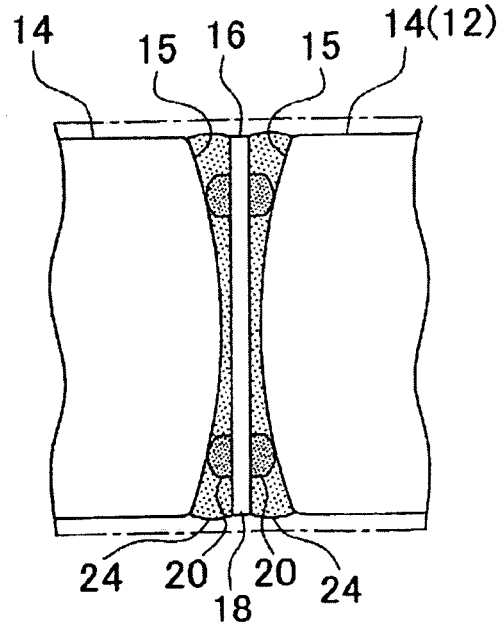
FIG. 1B is a partial plan view showing a modification example of projections formed on the gap plate included in the bonding portion similar to that in FIG. 1A.

The projections 20 are columnar shaped, and the height of each projection 20 is appropriately set in accordance with, for example, the degree of the bulge of the curved side face 15 and the distance d from the plate center C to the projection 20. Further, the tip end of each projection 20 may be substantially hemispherical as shown in FIG. 1B. If the tip ends of the projections 20 are substantially hemispherical, the tip ends of the projections 20 are brought into surface contact with the curved side face 15 of the intermediate core member 14. As a result, the projections 20 stably contact the curved side face 15.

In the process of assembling the core 10, the gap plate 16 with an adhesive 24, such as an epoxy resin adhesive or a phenol resin adhesive applied onto both faces is interposed between the curved side faces 15 of two core members 14 to adhesively-fix these two core members 14 to each other. Because tile projections 20 are at equal distances d from the plate center C and no projection is formed at the plate center C, the tip ends of the projections 20 formed on the gap plate 16 contact the curved side face 15 of the core member 14 in a uniform manner. This makes it possible to adhesively-fix the intermediate core members 14 to each other in the state where these intermediate core members 14 are in proper alignment without inclination. This effect is produced also when the intermediate core member 14 is adhesively-fixed to the end core members 12 of which the bonding face is formed in the curved side face 15.

Therefore, according to the embodiment of the invention, it is possible to suppress stress concentration in the adhesive layer 24, formed between the core member 14 and the core member 14 (12), which is likely to occur when the core 10, formed by adhesively-fixing the end core members 12 and the intermediate core members 14 to each other in the above-described manner, is fixed in a reactor case. As a result, it is possible to maintain the strength of bond between the core members 12,14 and suppress bond separation between the core members. This makes it possible to avoid degradation of noise-vibration performance of the reactor and to reduce variation in the noise-vibration performance among the reactors that have the same configuration. In particular, the plate 18 has a rectangular shape that matches the contour of the curved side face 15 of each of the core members 12 and 14, and the projections 20 are formed near the four corners 22 of the rectangular plate 18. In other words, the projections 22 are formed near the corners 22 that are the positions most distant from the plate center C within the plate 18. With this configuration, the projections 20 contact the curved side face 15 of each of the core members 12 and 14 in a more uniform manner. This allows the core members 12 and 14 and the projections 20 to more stably contact each other in the direction X. As a result, the core members 12 and 14 are adhesively-fixed to each other in the state in which they are in proper alignment with little inclination. Further, one projection 20 is formed near each of the four corners 22 that are the positions most distant from the plate center C within the plate 18. This makes it possible to minimize the number of the projections 20, whereby the manufacturing cost is reduced. In addition, the core members 12 and 14 are adhesively-fixed to each other in a more proper alignment with less inclination.

After the core members 12 and 14 are assembled together into the core 10, resin layers 26 may be formed on only an outer peripheral face and an inner peripheral face of the core 10 by means of insert molding as shown in FIG. 1A. In this case, if there is inclination or misalignment of the intermediate core members 14 in the direction Z, the resin enters a clearance formed between the core 10 and an inner face of the mold, and the top and bottom faces of the intermediate core members 14, which serve as beat-radiating faces (faces perpendicular to the direction Z), are partially coated with the resin that has entered the clearance. This degrades heat radiation performance of the core 10. However, in the core 10 for a reactor according to the embodiment of the invention, the intermediate core members 14 are adhesively-fixed to each other in proper alignment without inclination, and therefore, the resin that forms the resin layers on the outer peripheral face and the inner peripheral face of the core 10 does not flow onto the heat-radiating faces of the core 10. As a result, the heat radiation performance of the core 10 is not degraded.

The projections 20 are formed at the positions near the four corners of the rectangular plate 18 according to the embodiment of the invention. However, the invention is not limited to this configuration, and the outer configuration of the plate that constitutes the gap plate and the number of the projections may be appropriately changed in accordance with, for example, the configuration of the bonding face of the core member.

What is claimed is:

1. A core for a reactor, comprising:

a plurality of core members, each of which has a convexly curved side face that serves as a bonding face; and a gap plate that is interposed between the curved side faces of the core members and that is bonded to the curved side faces, wherein, the gap plate includes;

a flat plate, and a plurality of projections which project from each face of the plate and each of which has a tip end that contacts the curved side face, and the projections are formed at positions near outer edges of the plate, which are distant from a center of the plate at which no projection is formed, and which are at equal distances from the center of the plate.

2. The core according to claim 1, wherein:

the plate has a rectangular shape that matches a contour of the curved side face of each of the core members; and the projections are formed near four corners of the plate.

3. The core according to claim 2, wherein the number of the projections formed at each of the four corners is one.

4. The core according to claim 1, wherein the tip end of each of the projections is substantially hemispherical.

* * * * *

UNITED STATES PATENT AND TRADEMARK OFFICE

CERTIFICATE OF CORRECTION

PATENT NO. : 7,679,483 B2
APPLICATION NO. : 12/372939
DATED : March 16, 2010
INVENTOR(S) : Hiroaki Yuasa et al.

It is certified that error appears in the above-identified patent and that said Letters Patent is hereby corrected as shown below:

Column 2, line 38 - insert the word --no-- before the word "projection"
Column 3, line 45 - delete the word "arc" and insert --are--
Column 3, line 52 - delete the word "hut" and insert --but--
Column 4, line 23 - delete the word "tile" and insert --the--
Column 5, line 7 - delete the word "beat" and insert --heat--

Signed and Sealed this

Ninth Day of November, 2010

David J. Kappos

David J. Kappos
*Director of the United States Patent and Trademark Office*